United States Patent [19]

Gray

[11] Patent Number: 4,608,770

[45] Date of Patent: Sep. 2, 1986

[54] SNAP FITTING PICTURE FRAME COLLAGE

[76] Inventor: Robert R. Gray, 6297 Carol Dr., Brook Park, Ohio 44142

[21] Appl. No.: 635,908

[22] Filed: Jul. 30, 1984

[51] Int. Cl.[4] ..... A47G 1/06; G09F 1/12

[52] U.S. Cl. ..... 40/152; 40/152.1

[58] Field of Search ..... 40/152, 152.1, 156; 446/108, 109, 110, 116, 125; 220/76; 52/311, 590

[56] References Cited

U.S. PATENT DOCUMENTS

| | | | |
|---|---|---|---|
| 2,388,297 | 11/1945 | Slaughter | 446/116 |
| 2,791,051 | 5/1957 | Scheyer | 40/152.1 |
| 3,339,302 | 9/1967 | Mallory | 40/152 |
| 3,594,940 | 7/1971 | Yonezawa | 446/108 |
| 3,611,604 | 10/1971 | Saltzman | 40/156 |
| 3,921,312 | 11/1975 | Fuller | 446/116 |

FOREIGN PATENT DOCUMENTS

| | | | |
|---|---|---|---|
| 87624 | 9/1983 | European Pat. Off. | 40/152.1 |
| 270206 | 8/1950 | Switzerland | 40/156 |
| 647812 | 12/1950 | United Kingdom | 52/590 |

*Primary Examiner*—Robert Peshock
*Assistant Examiner*—Cary E. Stone
*Attorney, Agent, or Firm*—Fay, Sharpe, Fagan, Minnich & McKee

[57] ABSTRACT

A plurality of picture frames (A) are interconnected with connecting segments (B) to form a collage. Each frame includes a transparent display region (10) which may be circular, hexagonal, rectangular, or the like, behind which pictures are mounted. A border (12) surrounds the display region and defines a plurality of male connector segments (20) and a plurality of interengaging female connector segments (22). Each male connector segment includes a rearward projecting rib (24) and an angled slot (26). Each female connector portion includes a forward projecting rib (28) and a forward facing slot (30). The male connector rib is snap fit in the female connector slot and the female rib is slidably received and cammed into continued engagement by the sloping male connector slot. A foam backing card (16) holds the picture against the display region and provides apertures (60, 62, 64, 66) for receiving a nail or other hanger.

10 Claims, 18 Drawing Figures

FIG. 1
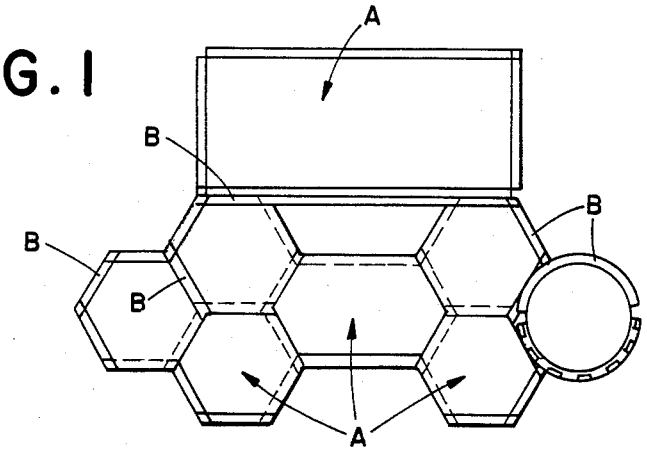
FIG. 2
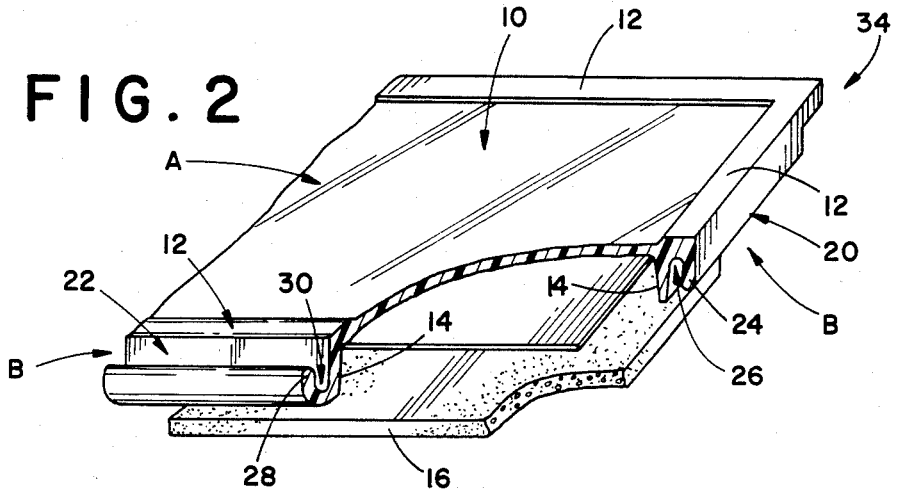
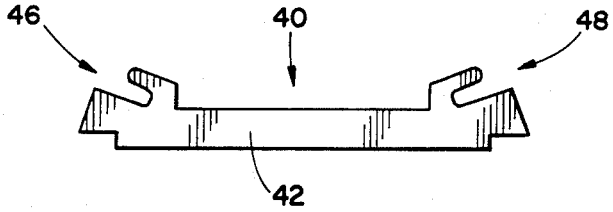
FIG. 3A

SNAP FITTING PICTURE FRAME COLLAGE

BACKGROUND OF THE INVENTION

The present invention relates to structures for supporting and displaying artwork and graphics. More particularly, the preferred embodiment relates to artwork mounting structures which are interconnectible to form a composite picture or collage. It is to be appreciated, however, that the present invention has other applications including making signs or announcements by selectively interconnecting letters or words, or providing other pictorial or graphic displays.

Heretofore, individual picture frames have been available in a variety of shapes and sizes. To form a collage or display, a plurality of individual picture frames were hung independently on a wall or other supporting surface in an appropriate pattern.

To faciliate multi-picture displays, others have produced unitary picture frames with multiple picture receiving areas or windows. Each unitary frame included a fixed number of picture receiving areas of a fixed size in a fixed array.

The prior art unitary picture frames were best adapted for hanging alone. They were difficult to arrange in a close-packed array to form a collage. The picture frames with multiple picture receiving windows lacked flexibility. Each held a fixed number of pictures, of a fixed size, and in a fixed orientation. The artwork was forced to conform to the picture frame which placed restrictions on the display format and the artist's creativity.

The present invention contemplates a new and improved picture mounting structure which facilitates interconnection of pictures of varying shapes and sizes in an individually selected array or pattern which conforms to the size, number, and desired display of the artwork.

SUMMARY OF THE INVENTION

In accordance with the present invention, there is provided a framed picture collage. The collage includes a plurality of picture frames having regular geometric shapes. Connecting means are provided for selectively interconnecting the picture frames into a unitary collage.

In accordance with another aspect of the present invention, a picture frame is provided which is adapted to be interconnected with other picture frames. The picture frame includes a display region for receiving artwork surrounded by a border portion having a regular geometric shape. A plurality of male and female frictional connecting portions are connected with the border portion in a regular geometric array.

A primary advantage of the present invention is that it provides freedom in the number, size, and arrangement of pictures.

Another advantage of the present invention is that it is relatively quick and easy to assemble custom collages.

Another advantage of the present invention is that it is relatively economical to manufacture.

Still further advantages will become apparent upon reading and understanding the following detailed description of the preferred embodiments.

BRIEF DESCRIPTION OF THE DRAWINGS

The invention may take form in various parts and arrangements of parts. The drawings are only for purposes of illustrating a preferred embodiment of the invention and are not to be construed as limiting it. Wherein the drawings show:

FIG. 1 illustrates a collage of interconnected picture frames of several sizes and shapes in accordance with the present invention;

FIG. 2 is a perspective view in partial section of a corner of the rectangular frame of FIG. 1;

FIG. 3A is a side view of a support holder for supporting a frame alone or in combination with other frames;

DETAILED DESCRIPTION OF THE PREFERRED EMBODIMENTS

Figure 4A:
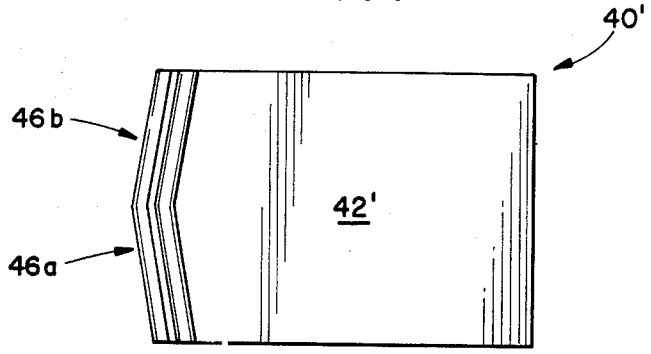
FIGS. 4A and 4B are top and side views respectively of a holder for supporting a hexagonal frame alone or in conjunction with additional frames.

With reference to FIG. 1, a plurality of frames A are interconnected by connecting means B to form a collage. As additional pictures or graphics are acquired, additional frames may be interconnected with the collage expanding it. Moreover, the connecting means allow the frames to be selectively disconnected such that the configuration of the collage may be freely altered.

With reference to FIG. 2, each frame A includes a regular geometrically shaped display region 10 for displaying a picture or other artwork. A border portion 12 surrounds the display region and is integrally formed with the connecting means B. An inner surface of the border portion defines a picture mounting means for mounting a picture behind the transparent display region. The picture mounting means is defined by the inward tapering interior wall or surfaces 14 of the border portion. As a compressible backing card 16 is pressed between the inward tapering walls, it is compressed into a firm frictional fit.

The border portion 12 includes a plurality of male connecting portions or means 20 and a plurality of female connecting portions or means 22 which are dimensioned for selective frictional interengagement. The male connecting means includes a rearward extending projection 24 and a groove 26 facing rearward of the picture frame. The female connecting means includes a outward extending projection 28 which is frictionally receivable in the male connecting portion groove 26 and defines an outward facing slot 30 which frictionally receives the male connecting portion projection 24. A relief region is provided at each corner to facilitate interconnection with an elongated side of the corresponding connecting portion of another frame or corresponding connecting portions at corners of a pair of frames. At relief regions at which a male and a female connecting means abut, there are cutouts at which the boarder portion 12 and the male and female projections 24, 28 are discontinuous. At relief regions 34 between adjoining male connection means and adjoining female connection means, the boarder 12 is continuous and only the male and female projections 24, 28 are discontinuous. Optionally, decorative buttons may be provided for covering the corner relief regions.

Figure 3B:
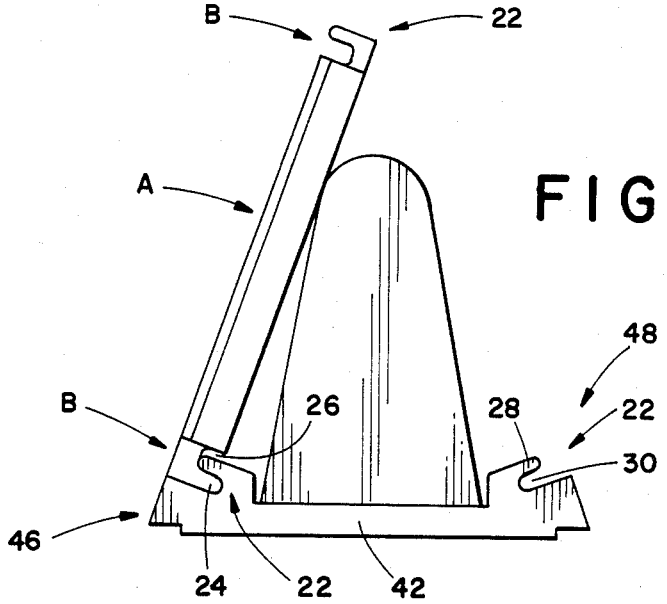
FIG. 3B is a side view of a support holder supporting a rectangular frame.

With reference to FIGS. 3A and 3B, a frame support stand 40 enables one or more interconnected frames to be displayed on a table top. The display stand includes a base portion 42 to be supported on the horizontal surface. A pair of connecting portions 46 and 48 extend along opposite ends for selective interconnection with one of the connecting portions of a frame or pair of back-to-back frames to be supported. In the embodiment of FIG. 3B, the illustrated connecting portions are linear female connecting portions 22 each including a female projection 28 and a female groove 30. This facilitates interconnection with a male connecting portion 20 including a male projection 24 and a male groove 26 of a square or rectangular frame or with one linear edge of a hexagonal frame, or the like.

Figure 4B:
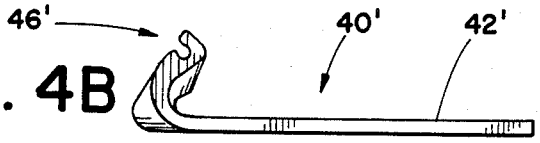

FIGS. 4A and 4B illustrate an alternate embodiment of the display stand of FIG. 3 for mounting hexagonal frames 30° rotated from the stand of FIG. 3A. In the embodiment of FIG. 4, like elements with the stand of FIG. 3 are denoted with the same reference numerals but followed by a primed suffix (′). The FIGS. 4A and 4B stand 40′ includes a horizontal portion 42′ to be supported on a table or other horizontal surface and an upstanding portion 44′. A connecting means 46′ extends along the edge of the upstanding portion. In the FIGS. 4A and 4B embodiment, the connecting means includes a first linear connecting portion **46*a* and a second linear connecting portion 46*b*** which are disposed coplanar but at a 60° angle relative to each other.

Figure 5:
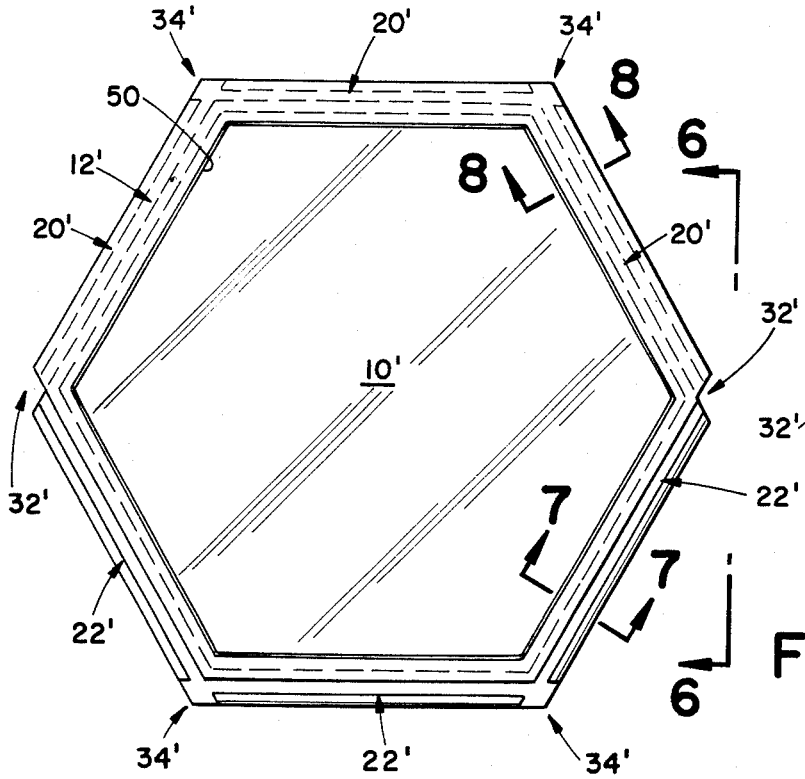
FIG. 5 is a top view of a hexagonal frame in accordance with the present invention.
Figure 6:
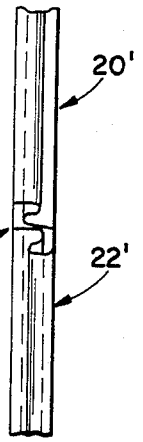
FIG. 6 is a side view of the hexagonal frame of FIG. 5.

A hexagonal embodiment of the frame A is illustrated in FIGS. 5, 6, 7, and 8. In FIGS. 5–8, like elements with the rectangular frame of FIG. 2 are denoted by the same reference numerals but followed by a primed suffix (′). With reference to FIGS. 5 and 6, display region 10′ is surrounded by a border portion 12′. The border includes a decorative accent stripe 50 such as a gold or silver band, extending peripherally around the display region. The border portion further includes three contiguous male connecting portions 20′ and three contiguous female connecting portions 22′. The boarder portion 12′ is discontinuous at relief region cutouts 32′ between adjoining male and female connecting portions and continuous at relief regions 34′ between adjoining male connecting portions and adjoining female connecting portions. By positioning the male connecting portions continguous with each other and the female portions contiguous with each other, male and female connecting portions are disposed on diametric opposite sides of the frame to facilitate ready interconnection among like frames. Optionally, the male and female connecting portions could be disposed alternately, one frame could have all male connecting portions and another all female connector portions, or the like.

Figure 7:
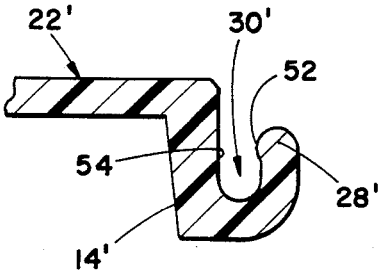
FIG. 7 is an enlarged sectional view of a female connecting structure through section 7—7 of FIG. 5.

With reference to FIG. 7, the female connecting portion includes a female outward projecting rib 28′ which includes an enlarged bead 52 projecting inward into a female outward facing slot 30′. A generally vertical wall 54 defines the inside edge of the outward facing slot.

Figure 8:
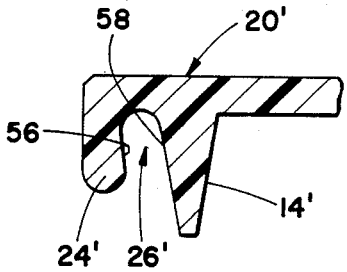
FIG. 8 is an enlarged sectional view of a male connecting structure through section 8—8 of FIG. 5.

With reference to FIG. 8, the male connecting portion includes a male rearward projecting rib 24′ and a male rearward facing slot 26′. The male rearward projecting rib has a sloping inner surface 56 such that the rearward projecting rib is wider at its rearmost end relative to its more outward end. The sloping surface 56, in conjunction with a like sloping surface 58, defines the male rearward facing slot 26′.

With continuing reference to FIGS. 7 and 8, the male rearward facing slot 26′ has sufficient width to receive the enlarged bead portion 52 of the female outward projecting rib 28′ therein. The female outward facing slot 30′ is narrower than the widened rearmost end of the male rearward facing rib 24′. As the male and female portions are connected, the outward projecting rib 28′ flexes to allow the ribs to move past each other into the corresponding slots. Once the ribs are received in the slots, the slope of surfaces 56 and 58 of the male connector urge the female outward facing rib 28′ deeper into the male rearward facing slot 26′ under forces which would tend to pull the frames apart. In this manner, continued interconnection is assured.

Figure 9:
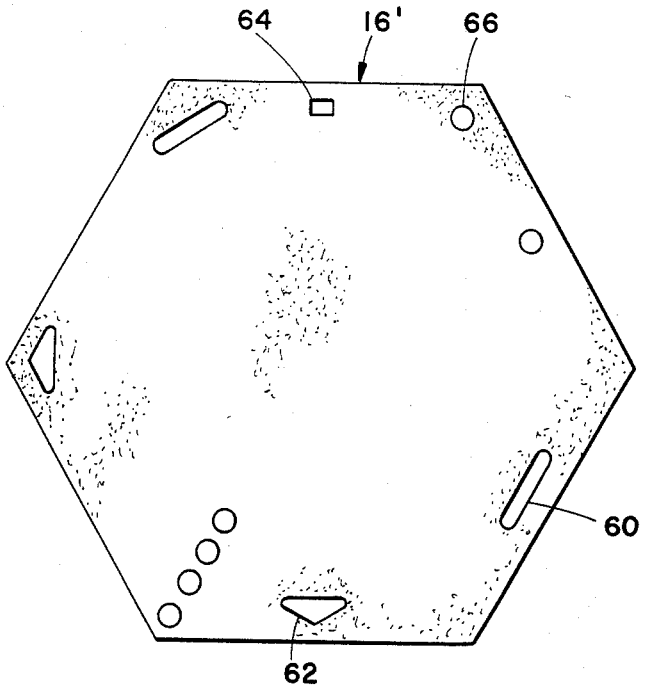
FIG. 9 is a plan view of a hexagonal backing card in accordance with the present invention.
Figure 10:
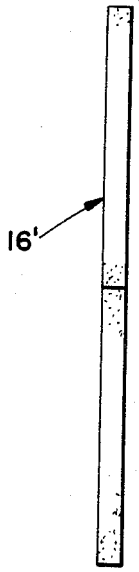
FIG. 10 is a side view of the backing card of FIG. 9.

FIGS. 9 and 10 illustrate an alternate embodiment of a backing card 16′ which is dimensioned for the hexagonal frame embodied in FIGS. 5 and 6. The backing card is a stiff foam sheet, which is slightly larger than the region defined by the border portion interior walls 14′. Pressing the backing card into the border portion compresses the resilient foam to form a secure frictional interengagement. The backing sheet is die cut with apertures for receiving an appropriate hanger. The hanger apertures may be elongated, as illustrated by aperture 60, to allow lateral shifting. The hanger apertures may also be tapered, as illustrated by aperture 62, to be self-centering, may be small hanger-sized apertures 64 or 66, or the like. Preferably, the apertures are provided at one or more corners and midway along one or more linear sides to provide flexibility in orientations at which the frame may be hung.

Figure 11:
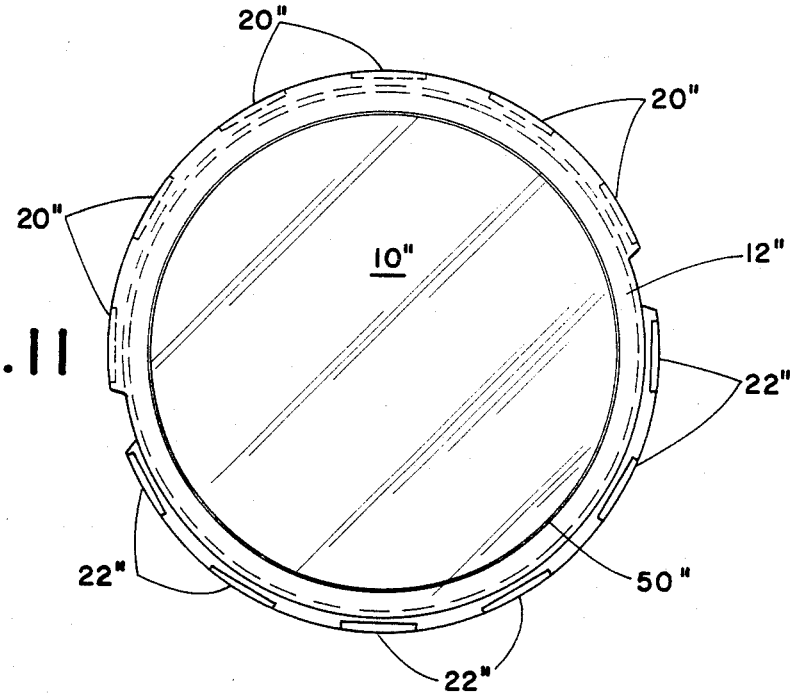
FIG. 11 illustrates a circular frame with a duodecimal array of connectors.

FIG. 11 illustrates another alternate embodiment of the frame A in which like elements with the embodiment of FIG. 2 are denoted by a doubly primed suffix (″). A circular display region 10″ is surrounded by a circular border 12″. A duodecimal array of linear male connection portions 20″ and female connection portions 22″ surround the frame.

Figure 13:
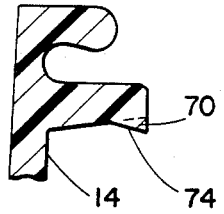
FIG. 13 is a sectional view through section 13—13 of FIG. 12.
Figure 12:
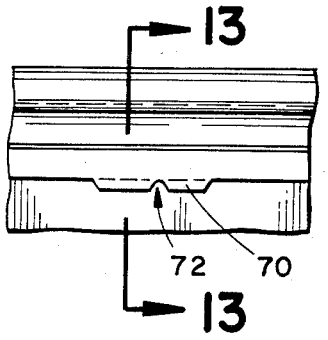
FIG. 12 is a partial view of an alternate embodiment of a frame with a combined hanger centering and backing card anchoring structure.

FIGS. 12 and 13 illustrates an alternate structure for retaining the pictures in the frame and for hanging the frame. A plurality of lips 70 are disposed along the sloping interior walls 14 of the border portions to hold the picture and the backing card 16 in the frame. Each lip has a centering recess 72 for receiving and centering the nail or other hanger. The centering recess is disposed along a center of gravity of the frame such that the frame tends to hang vertically. Each lip 70 has a sloping surface 74 which, when the picture frame is hung vertically, slopes upward. The upward sloping surface 74 under gravity and vibration provides a camming force which urges the lip and associated frame to slide along the mounting nail toward the wall surface. In this manner, the sloping lip helps to hold the frame against the wall.

Figure 14:
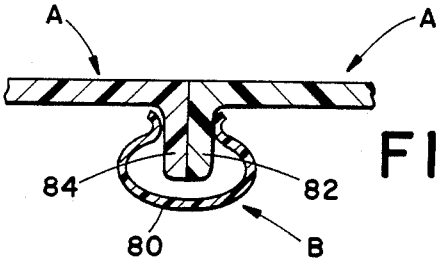
FIG. 14 is an alternate embodiment of the connecting means for connecting adjoining frames.

The connecting means B may take other forms. With reference to FIG. 14, the connecting means may include a U-shaped, spring clip 80 which clamps rearward projections 82, 84 of adjacent frames together.

Figure 15:
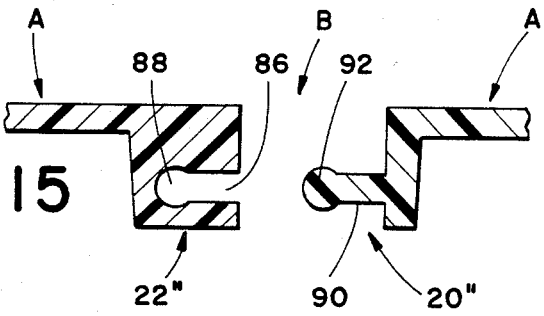
FIG. 15 is another alternate embodiment of the male and female connecting means.

Alternately, as illustrated in FIG. 15, the female connecting portion may include a slot 86 extending parallel to the face of the frame having an enlarged portion 88 at the inner end thereof. The male portion may include a projecting rib 90 member with an enlarged end 92 extending parallel to the face of the associated frame such that the projection rib 90 is resiliently receivable in the slot 86.

Figure 16:
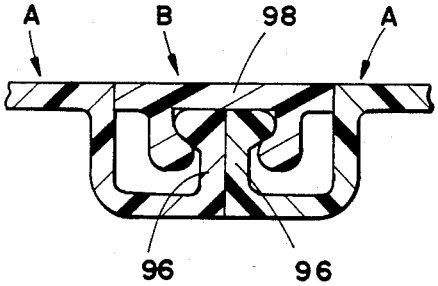
FIG. 16 is another alternate embodiment in which a decorative strip connects the frames; and, FIG. 17 is yet another alternate embodiment of the male and female connecting means.

With reference to FIG. 16, adjacent frames may include outward projecting ribs 94, 96, which are connected together with a decorative spring strip 98. The spring strip snaps over the outward projecting ribs and spring biases them together. The decorative strip 90 faces the viewer to provide a decorative appearance.

Figure 17:
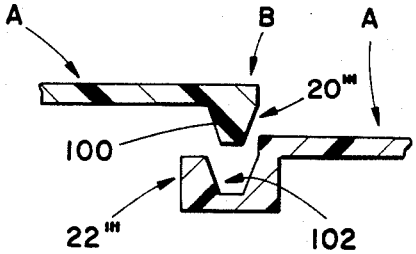

With reference to FIG. 17, a male portion 20''' includes a rib 100 with a trapezoidal transverse cross section. A female portion 22''' includes a matching trapezoidal groove 102. The trapezoidal rib 100 is snap-fit in the trapezoidal groove 102 and frictionally held.

The invention has been described with reference to the preferred embodiments. Obviously, modifications and alterations will occur to others upon reading and understanding the preceding detailed description. It is intended that the invention be construed as including all such alterations and modifications insofar as they come within the scope of the appended claims or the equivalents thereof.

Having thus described a preferred embodiment of the invention, the invention is now claimed to be:

1. A collage of picture frames which are readily, manually snap fit together and apart to be selectively arranged and rearranged, at least first and second frames each comprising:

a plurality of interior walls extending forward to rearward and integrally interconnected end to end in a regular geometric array to define a picture receiving region therein, the interior wall geometric array having a forward facing edge and a rearward facing edge, a front face portion through which a received picture is viewable integrally connected with the interior wall array forward facing edge such that the picture receiving region is defined rearward of the front face portion surrounded by the interior walls;

the planar front face portion overhanging a first half of the interior walls and terminating adjacent a second half of the interior walls;

a plurality of rearward projections integrally connected to the overhanging front face portion and projecting rearwardly therefrom, each rearward projection extending parallel to and generally coextensive with a corresponding adjacent interior wall such that linearly extending rearward facing grooves are defined therebetween;

a rear portion extending integrally outward from the second half of the interior walls a distance commensurate with the front face portion overhang;

a plurality of forward projections integrally connected to the rear portion and projecting forward therefrom, each forward projection extending parallel to and coextensive with a corresponding, adjacent interior wall such that a plurality of linear extending, forward facing grooves are defined between the forward projections and the corresponding, adjacent interior walls;

the rearward projections of the first frame each being receivable in one of the forward facing grooves of the second frame and the forward projections of the second frame each being receivable in one of the rearward facing grooves of the first frame;

each of the rearward projections having a planar outer wall surface disposed substantially perpendicular to the front face portion and each of the second half interior walls having a planar outer wall surface which defines one surface of the facing groove disposed substantially perpendicular to the front face portion, such that the rearward projection planar outer wall surface of the first frame abuts the second half interior wall outer surface of the second frame, whereby the planar outer wall surfaces fix the first and second frames in a coplanar relationship;

the rearward and forward projections each having sloping inner walls, such that the sloping inner rearward and forward projection walls of connected first and second frames abut;

each of the first frame rearward projections being dimensioned for tight, frictional engagement into the second frame forward facing grooves such that the adjacent second frame forward projection is cammed outward by the receipt of the first frame rearward projection in the second frame forward facing groove, such that resiliency of the outward cammed second frame forward projection holds the first and second frames frictionally engaged;

each of the first frame forward projections being dimensioned to be loosely received in each of the second frame rearward facing grooves such that the second frame forward projection is cammed outward by the first frame rearward projection without camming the first frame portion rearward projection such that deformation of the first frame adjacent the first frame rearward projection which would move the second frame out of a coplanar relationship with the first frame is avoided.

2. The collage as set forth in claim 1 wherein each frame has six interior walls of equal length interconnected in a regular hexagonal array such that a hexagonal frame is defined.

3. The collage as set forth in claim 1 wherein each frame has four interior walls at least opposite pairs of which are of substantially the same length, the four interior walls being interconnected in a regular geometric array.

4. The collage as set forth in claim 1 wherein the plurality of interior walls define a circular inner surface and a duodecigonal outer surface, the front face portion overhang terminates along a semicircular arc segment and the rear portion terminates along a complimentary generally semicircular arc segment, each frame having six rearward projections and six forward projections.

5. The collage as set forth in claim 1 further including a compressible backing card which is dimensioned to be compressibly received within the plurality of geometric array of interconnected interior walls to secure the received picture therein.

6. A collage of picture frames including at least a first frame and a second frame which are manually snap fit together and which are adapted to be selectively snapped apart and rearranged, the first frame comprising:

a first interior wall array which defines a first picture receiving region therein, the first interior wall array has a first forward facing edge and a first rearward facing edge;

a first front face portion, through which a received picture is viewable, is integrally connected with the first interior wall array forward facing edge such that the first picture receiving region is defined rearward of the first front face portion surrounded by the first interior wall array;

the first front face portion has an overhang which overhangs at least a portion of the first interior wall array;

a rearward projection is integrally connected to the first front face portion overhang and projects rearward therefrom, the rearward projection extends parallel to an outer surface of an adjacent portion of the first interior wall array such that a rearward facing groove is defined therebetween, the rearward projection has a planar outer wall surface disposed substantially perpendicular to the first front face portion;

the second frame comprising:

a second interior wall array which defines a second picture receiving region therein, the second interior wall array has a second forward facing edge and a second rearward facing edge;

a second front face portion, through which a received picture is viewable, is integrally connected with the second interior wall array forward facing edge such that the second picture receiving region is defined rearward of the second front face portion surrounded by the second interior wall array;

a rear portion extends integrally outward from a portion of the second interior wall array;

a forward projection is integrally connected to the rear portion and projects forward therefrom, the forward projection extends parallel to an adjacent portion of the second interior wall array such that a forward facing groove is defined therebetween, the adjacent second interior wall array portion has a planar surface which is disposed substantially perpendicular to the second front face portion;

the rearward projection of the first frame is received in the forward facing groove of the second frame camming the forward projection permanently away from the second interior wall array such that the resiliency of the forward projection and the rear portion holds the rearward projection planar outer surface and the second interior wall array planar surface in abutting relationship such that the first and second front face portions are held substantially parallel;

the forward projection of the second frame is loosely received in the rearward facing groove of the first frame such that the rearward projection is not cammed outward away from the first interior wall array after the forward projection is received in the rearward facing groove, whereby deformation of the overhang is avoided.

7. At least one picture frame mounted on a stand, the frame comprising:

a plurality of interior walls are interconnected into an array, the interior wall array defines a forward facing edge and a rearward facing edge;

a front face portion, through which a framed picture is viewable, is integrally connected with the array forward facing edge, the front face portion overhanging at least one of the interior walls;

a linearly extending rearward projection is integrally connected to the overhanging front face portion and projects rearwardly therefrom, the rearward projection extends parallel to and generally coextensive with an outer surface of a corresponding, adjacent interior wall such that a linearly extending, rearward facing groove is defined between the rearward projection and the corresponding adjacent interior wall outer surface;

the stand comprising:

a base portion for supporting the stand on a horizontal surface;

a stand projection extends generally along an upper edge of the stand and is loosely received in the frame rearward facing groove;

the stand projection and the base portion define a stand groove therebetween, the rearward frame projection is received in the stand groove in a tight frictional engagement such that the frame is mounted to the stand.

8. A collage of picture frames which are snap fit together to be selectively arranged and rearranged, the collage being mounted on a stand which is supportable by a generally horizontal surface, the stand comprising:

a base portion which is configured to be supported by the horizontal surface;

a linear stand groove defined between the base portion and a linearly extending stand projection, the stand groove having a planar face on a base portion side thereof disposed at a preselected angle relative to horizontal; one of the frames comprising:

a plurality of interior walls interconnected in a regular geometric array;

a front face portion through which a framed picture is viewable integrally connected with the interior wall array, the front face portion overhanging a first half of the interior walls;

a plurality of rearward projections integrally connected to the overhanging front face portion and projecting rearwardly therefrom, each rearward projection extending parallel to and generally coextensive with an adjacent, corresponding interior wall such that linearly extending rearward facing grooves are defined therebetween, each rearward projection having a generally planar outermost surface which is disposed substantially perpendicular to the front face portion;

a plurality of forward projections operatively connected with the interior walls, each forward projection projecting forward and extending generally parallel to and coextensive with a corresponding interior wall such that linearly extending forward facing grooves are defined therebetween;

one of the rearward projections being frictionally received in the stand groove with the planar rearward projection outermost surface abutting the stand groove planar face, the frame projection being dimensioned slightly wider than the stand groove such that the stand projection is cammed outward by receipt thereof, whereby resiliency of the stand grasps the rearward projection in the stand groove between the base portion and the stand projection such that the frame is mounted on the stand with the front face portion thereof disposed at said preselected angle relative to vertical.

9. The collage as set forth in claim 8 wherein a plurality of frames are snap fit to the frame which is supported by the stand such that the plurality of frames in the collage are supported by the stand.

10. The collage as set forth in claim 8 wherein the forward and rearward projections are discontinuous adjacent corners at which the interior walls are interconnected such that relief regions are formed at each corner.

* * * * *